US010431151B2

(12) United States Patent
Song et al.

(10) Patent No.: US 10,431,151 B2
(45) Date of Patent: Oct. 1, 2019

(54) PIXEL ARRAY, DISPLAY DEVICE AND DRIVING METHOD THEREOF, AND DRIVING DEVICE

(71) Applicant: BOE TECHNOLOGY GROUP CO., LTD., Beijing (CN)

(72) Inventors: Danna Song, Beijing (CN); Zhongyuan Wu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 61 days.

(21) Appl. No.: 15/085,124

(22) Filed: Mar. 30, 2016

(65) Prior Publication Data

US 2017/0039990 A1 Feb. 9, 2017

(30) Foreign Application Priority Data

Aug. 5, 2015 (CN) ..... 2015 1 0474614

(51) Int. Cl.
*G09G 3/3225* (2016.01)
*G09G 3/20* (2006.01)

(52) U.S. Cl.
CPC ..... *G09G 3/3225* (2013.01); *G09G 3/2003* (2013.01); *G09G 2300/0452* (2013.01); *G09G 2300/0465* (2013.01)

(58) Field of Classification Search
None
See application file for complete search history.

(56) References Cited

U.S. PATENT DOCUMENTS 7,705,855 B2 * 4/2010 Brown Elliott ..... G09G 5/028 345/589
2003/0034992 A1 * 2/2003 Brown Elliott ..... G06T 3/4015 345/690

(Continued)

FOREIGN PATENT DOCUMENTS

CN 103778888 A 5/2014
CN 103886808 A * 6/2014 ..... G09G 3/2003

(Continued)

OTHER PUBLICATIONS

CN office action dated Dec. 30, 2016 for corresponding CN application CN 201510474614.8 with English translation.

*Primary Examiner* — Chanh D Nguyen
*Assistant Examiner* — Karin Kiyabu
(74) *Attorney, Agent, or Firm* — Nath, Goldberg & Meyer; Joshua B. Goldberg

(57) ABSTRACT

The invention provides a pixel array, including N rows and M columns of pixel units, wherein each pixel unit includes two sub-pixels, two adjacent pixel units in the same row include sub-pixels of three colors including a red sub-pixel, a green sub-pixel and a blue sub-pixel, every two adjacent sub-pixels in the same row have different colors, in the pixel array, all the sub-pixels have the same shape, every two adjacent green sub-pixels are provided with a sub-pixel of other color therebetween, and every two adjacent blue sub-pixels are provided with three sub-pixels of other colors therebetween. The invention also provides a display device, a driving method and a driving device. Employing the pixel array of the invention, an image is displayed with a higher visual resolution, and a mask plate for manufacturing the pixel array has a larger minimal size, and the pixel array is manufactured with high yield.

6 Claims, 2 Drawing Sheets

(56) References Cited

U.S. PATENT DOCUMENTS

2003/0085906 A1* 5/2003 Elliott ..... G09G 3/20 345/613
2003/0128225 A1* 7/2003 Credelle ..... G02F 1/133514 345/694
2003/0146920 A1* 8/2003 Tezuka ..... G06T 15/503 345/629
2004/0061710 A1* 4/2004 Messing ..... G06T 3/4015 345/698
2004/0080479 A1* 4/2004 Credelle ..... G02F 1/133514 345/88
2007/0266943 A1* 11/2007 Yeh ..... C23C 14/042 118/721
2010/0118045 A1* 5/2010 Brown Elliott .... G02B 27/2214 345/589
2010/0149393 A1* 6/2010 Zarnowski ..... H04N 9/045 348/302
2012/0092238 A1* 4/2012 Hwang ..... G09G 3/20 345/55
2014/0043217 A1 2/2014 Kim et al.
2014/0198140 A1* 7/2014 Yano ..... G09G 5/10 345/696
2015/0237236 A1* 8/2015 Elliott ..... G09G 3/2003 345/600
2015/0371583 A1* 12/2015 Guo ..... G09G 3/2074 345/694
2016/0027369 A1* 1/2016 Guo ..... G09G 3/2003 345/694
2016/0104413 A1* 4/2016 Matsueda ..... H01L 27/3218 345/694
2016/0253943 A1* 9/2016 Wang ..... G09G 3/2003 345/694
2016/0275838 A1* 9/2016 Sun ..... G02F 1/1362
2016/0329026 A1* 11/2016 Lu ..... G09G 3/20
2016/0335741 A1* 11/2016 Zhao ..... G06T 3/40
2016/0343284 A1* 11/2016 Sun ..... H01L 51/0011
2016/0343315 A1* 11/2016 Richards ..... G09G 3/20
2017/0092175 A1* 3/2017 Guo ..... G09G 3/2003

FOREIGN PATENT DOCUMENTS

CN 103886825 A * 6/2014 ..... G09G 3/2074
CN 103943032 A 7/2014
CN 104299561 A 1/2015
EP 2081181 A2 7/2009

* cited by examiner

PIXEL ARRAY, DISPLAY DEVICE AND DRIVING METHOD THEREOF, AND DRIVING DEVICE

TECHNICAL FIELD

The invention relates to the field of display technology, and in particular, relates to a pixel array, a display device including the pixel array, a driving method of the display device and a driving device for driving the display device.

BACKGROUND ART

Pixel arrays in display devices are mainly divided into two kinds, a full color pixel array, and a sub-pixel rendering pixel array.

The full color pixel array includes a plurality of pixel units, as shown in FIG. 1*a*, each pixel unit includes three sub-pixels (i.e. a red sub-pixel, a green sub-pixel and a blue sub-pixel), and the three sub-pixels in each pixel unit have the same size.

The sub-pixel rendering pixel array also includes a plurality of pixel units dividing into two kinds of pixel units, as shown in FIG. 1*b*, one kind of pixel unit includes a red sub-pixel and a green sub-pixel, and the other kind of pixel unit includes a blue sub-pixel and a green sub-pixel, and each pixel unit includes two sub-pixels.

For the full color pixel array, each pixel has a too small size, and thus its fabrication is more difficult. For the sub-pixel rendering pixel array, the number of the sub-pixels is reduced, but the green sub-pixel has a smaller size. The minimal dimension of the mask plate for manufacturing the pixel array is the width of the green sub-pixel, and thus the minimal dimension of the mask plate is very small, which will easily lead to degradation.

Therefore, how to improve the minimal dimension of the mask plate so as to reduce degradation becomes a technical problem to be solved in this field.

SUMMARY OF THE INVENTION

In order to achieve the object, the invention provides a pixel array, a display device including the pixel array, a driving method for driving the display device, and a driving device for executing the driving method. Each sub-pixel in the pixel array has a larger size so as to increase the minimal dimension of the mask plate, and improve the yield.

In order to achieve the above object, as one aspect of the invention, a pixel array is provided to include N rows and M columns of pixel units, wherein each pixel unit includes two sub-pixels, two adjacent pixel units in the same row include sub-pixels of three colors including a red sub-pixel, a green sub-pixel and a blue sub-pixel, every two adjacent sub-pixels in the same row have different colors, and wherein in the pixel array, all the sub-pixels have the same shape, every two adjacent green sub-pixels are provided with a sub-pixel of other color therebetween, every two adjacent blue sub-pixels are provided with three sub-pixels of other colors therebetween, and every two adjacent red sub-pixels are provided with three sub-pixels of other colors therebetween, and wherein both N and M are positive integers greater than 1.

Preferably, in each column of sub-pixels except columns of green sub-pixels, starting from the first row of sub-pixels, every two adjacent rows of sub-pixels have the same color, and the nth row of sub-pixels and the (n+2)th row of sub-pixels have different colors.

Preferably, in the first row of pixel units, a starting sub-pixel is a red sub-pixel, and in the third row of pixel units, a starting sub-pixel is a blue sub-pixel.

As another aspect of the invention, a display device is provided, and the display device includes the above pixel array.

Preferably, the display device is a liquid crystal display device or an organic light emitting diode display device.

As another aspect of the invention, a driving method of a display device is provided, wherein the display device includes an actual pixel array, wherein the actual pixel array includes N rows and M columns of actual pixel units, each actual pixel unit includes two actual sub-pixels, two adjacent actual pixel units in the same row include actual sub-pixels of three colors including a red actual sub-pixel, a green actual sub-pixel and a blue actual sub-pixel, every two adjacent actual sub-pixels in the same row have different colors, and wherein in the actual pixel array, all the actual sub-pixels have the same shape, every two adjacent green actual sub-pixels are provided with an actual sub-pixel of other color therebetween, every two adjacent blue actual sub-pixels are provided with three actual sub-pixels of other colors therebetween, and every two adjacent red actual sub-pixels are provided with three actual sub-pixels of other colors therebetween, and wherein both N and M are positive integers greater than 1, the driving method includes:

Stp1. Dividing an image to be displayed into N rows and M columns of theoretical pixel units so that each theoretical pixel unit includes a red theoretical sub-pixel, a green theoretical sub-pixel and a blue theoretical sub-pixel, and the divided theoretical pixel units correspond to the actual pixel units one-by-one;

Stp2. Obtaining theoretical brightness values of the red theoretical sub-pixel, the green theoretical sub-pixel, and the blue theoretical sub-pixel of each theoretical pixel unit;

Stp3. Calculating actual brightness values of the actual sub-pixels from the theoretical brightness values of the theoretical sub-pixels so that actual brightness value of an actual sub-pixel is a sum of a part of theoretical brightness value of a corresponding theoretical sub-pixel and a part of theoretical brightness value of an auxiliary theoretical sub-pixel, the corresponding theoretical sub-pixel and the actual sub-pixel to be calculated have the same color, and a position of the theoretical pixel unit in which the corresponding theoretical sub-pixel is located corresponds to that of the actual pixel unit in which the actual sub-pixel to be calculated is located; the auxiliary theoretical sub-pixel and the actual sub-pixel to be calculated have the same color, and a position of the theoretical pixel unit in which the auxiliary theoretical sub-pixel is located is around that of the actual pixel unit in which the actual sub-pixel to be calculated is located, and does not correspond to that of the actual pixel unit in which the actual sub-pixel to be calculated is located;

Stp4. Controlling each actual sub-pixel to obtain the actual brightness value calculated in Stp3.

Preferably, in the step Stp3, the part of theoretical brightness value of the corresponding theoretical sub-pixel is a product of the theoretical brightness value of the corresponding theoretical sub-pixel and a first coefficient, the part of theoretical brightness value of the auxiliary theoretical sub-pixel is a product of the theoretical brightness value of the auxiliary theoretical sub-pixel and a second coefficient, both the first coefficient and the second coefficient are positive numbers not more than 1, and a sum of the first coefficient and the second coefficient equals to 1.

Preferably, the first coefficient for the green actual sub-pixel equals to 1.

Preferably, in each column of sub-pixels except columns of green sub-pixels, starting from the first row of sub-pixels, every two adjacent rows of sub-pixels have the same color, and the nth row of sub-pixels and the (n+2)th row of sub-pixel have different colors.

As another yet aspect of the invention, a driving device is provided, and the driving device is configured for executing the above driving method provided in the present invention, the driving device including:

a theoretical pixel unit dividing module, configured for dividing an image to be displayed into N rows and M columns of theoretical pixel units so that each theoretical pixel unit includes a red theoretical sub-pixel, a green theoretical sub-pixel and a blue theoretical sub-pixel, and the divided theoretical pixel units correspond to the actual pixel units one-by-one;

a theoretical brightness obtaining module, configured for obtaining theoretical brightness values of the red theoretical sub-pixel, the green theoretical sub-pixel, and the blue theoretical sub-pixel of each theoretical pixel unit;

an actual brightness calculating module, configured for calculating actual brightness values of the actual sub-pixels from the theoretical brightness values of the theoretical sub-pixels so that actual brightness value of an actual sub-pixel is a sum of a part of theoretical brightness value of a corresponding theoretical sub-pixel and a part of theoretical brightness value of an auxiliary theoretical sub-pixel, the corresponding theoretical sub-pixel and the actual sub-pixel to be calculated have the same color, and a position of the theoretical pixel unit in which the corresponding theoretical sub-pixel is located corresponds to that of the actual pixel unit in which the actual sub-pixel to be calculated is located; the auxiliary theoretical sub-pixel and the actual sub-pixel to be calculated have the same color, and a position of the theoretical pixel unit in which the auxiliary theoretical sub-pixel is located is around that of the actual pixel unit in which the actual sub-pixel to be calculated is located, and does not correspond to that of the actual pixel unit in which the actual sub-pixel to be calculated is located;

an illumination controlling module, configured for controlling each actual sub-pixel to obtain the respective actual brightness value.

With the pixel array provided by the invention, an image can be displayed with a higher visual resolution, and the mask plate for manufacturing the pixel array has a larger minimal dimension, and thus the resultant pixel array has a higher yield.

DESCRIPTION OF THE DRAWINGS

Drawings are used to provide a further understanding of the invention, and constitute a part of the specification, and will be used to interpret the invention in conjunction with following implementations, and will not limit the invention. In the drawings.

REFERENCE NUMERALS

| | | |
|---|---|---|
| R: red sub-pixel | G: green sub-pixel | B: blue sub-pixel |

DESCRIPTIONS OF EMBODIMENTS

Embodiments of the invention will be described in detail below in conjunction with the drawings. It should be understood that, the embodiments described herein are only used to illustrate and intercept the invention, and do not limit the invention.

Figure 2:
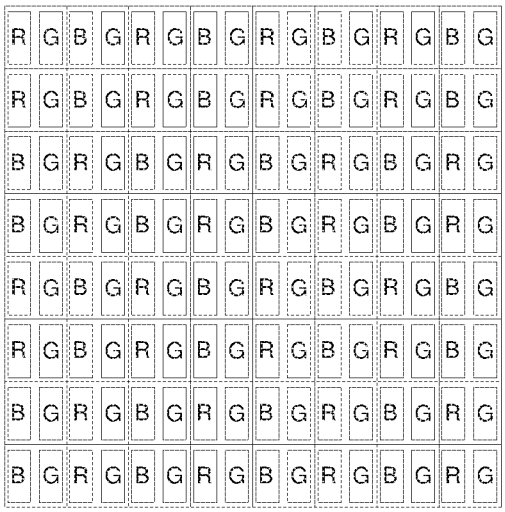
FIG. 2 is a schematic diagram of a pixel array according to one preferable embodiment of the invention.

As one aspect of the invention, a pixel array is provided to include N rows and M columns of pixel units, as shown in FIG. 2, each pixel unit includes two sub-pixels, two adjacent pixel units in the same row include three colors of sub-pixels, that is, a red sub-pixel R, a green sub-pixel G, and a blue sub-pixel B, every two adjacent sub-pixels in the same row have different colors, and in the pixel array, all the sub-pixels have the same shape, every two adjacent green sub-pixels G are provided with a sub-pixel of other color therebetween, every two adjacent blue sub-pixels B are provided with three sub-pixels of other colors therebetween, and every two adjacent red sub-pixels R are provided with three sub-pixels of other colors therebetween, and wherein both N and M are positive integers greater than 1.

Figure 1A:
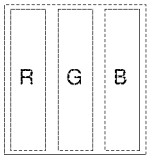
Fig. 1a (Prior Art)
FIG. 1*a* is a schematic diagram of a pixel unit in a full color pixel array in the prior art.

Although compared with the prior art shown in FIG. 1*a*, the pixel array provided by the invention has a relatively small number of sub-pixels, that is, a physical resolution of the pixel array provided by the invention is lower than that of the pixel array shown in FIG. 1*a*, when the pixel array of the invention is driven to display by the driving method of the invention, since two adjacent pixel units in the same row include sub-pixels of three colors (red sub-pixel R, green sub-pixel G and blue sub-pixel B), and each pixel unit can share a sub-pixel of its adjacent pixel unit to perform the display, the visual resolution of the display device may be higher than the physical resolution. The principle of the driving method will be described in detail below.

The human visual system deals with the object information received by eyes through the brightness information, the chrominance information and the motion state information. The motion state only affects the flicker threshold, only red light and green light transfer brightness information, and the brightness resolution of the human visual system is several times of the chrominance resolution, and the contribution of blue light to the brightness sensation can be neglected. According to statistics, when the number of blue sub-pixels B in an image is reduced by ⅛, most observers will not find an error in the image display. Compared with the prior art shown in FIG. 1*a*, the number of blue sub-pixels B in the invention is reduced by ⅛, and therefore, the display device including the pixel array of the invention can display substantially the same image as the display device including the pixel unit shown in FIG. 1*a*.

The color sense of human eyes is affected by an "assimilation" process, and in the "assimilation" process, the human eyes will mix separate sub-pixels of different colors which are displaying together to be sensed as a mixed color. The human eyes will mix color within a certain angle to be sensed, and as for blue color, the human eyes will mix blue sub-pixels B within 0.25 degrees to be sensed, and as for red or green color, the human eyes will mix red sub-pixels B or green sub-pixels G within 0.12 degrees to be sensed. Therefore, when the observation distance is 12 inches, the blue sub-pixels B within 1270 μm will be mixed, and the green sub-pixels G or the red sub-pixels R within 625 μm will be mixed. In the pixel array provided by the invention, a distance between every two adjacent blue sub-pixels B is not more than 1270 μm, therefore, a complete and delicate image can be displayed without sense of particles with the pixel array of the invention.

As described above, every two adjacent green sub-pixels G are provided with one sub-pixel of other color therebetween, i.e. a red sub-pixel R and a blue sub-pixel B are alternately arranged between green sub-pixels G. Brightness information that the green sub-pixel carries is the highest, about 60%, and the human visual system is most sensitive to the brightness information, thus, in the sub-pixel rendering pixel array, the green sub-pixels are reserved, and the number of the red sub-pixels and the number of the blue sub-pixels can be reduced by sharing.

Since the pixel array includes sub-pixels of three different colors, the red sub-pixels R, the green sub-pixels G and the blue sub-pixels B are formed in three different processes, respectively.

Figure 1B:
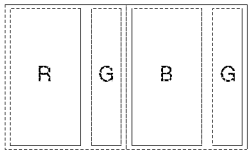
Fig. 1b (Prior Art)
FIG. 1*b* is a schematic diagram of two adjacent pixel units in a sub-pixel rendering pixel array in the prior art.

Since the red sub-pixels R, the green sub-pixels G, and the blue sub-pixels B are shaped of rectangular blocks, three different mask plates with openings are required to form the red sub-pixels R, the green sub-pixels G, and the blue sub-pixels B, respectively. In the pixel array provided by the invention, the width of the sub-pixel is half of the length of the sub-pixel, and therefore, two adjacent sub-pixels form a square. In the prior art shown in FIG. 1*a*, three sub-pixels form a square, and therefore, compared with the prior art shown in FIG. 1*a*, the minimal dimension of the mask plate for manufacturing the pixel array provided by the invention is slightly large. In the prior art shown in FIG. 1*b*, two sub-pixels forms a square, the size of one sub-pixel is significantly larger than that of the other one, and in the invention, all the sub-pixels have the same size. Therefore, the different mask plates for manufacturing the pixel array have the same minimal dimension. Therefore, compared with the prior art shown in FIG. 1*b*, the minimal dimension of the mask plate for manufacturing the pixel array provided by the invention is slightly larger.

As described above, with the pixel array provided by the invention, an image can be displayed with a higher visual resolution, and the mask plate for manufacturing the pixel array has a larger minimal dimension, and thus the resultant pixel array has a higher yield.

In the invention, arrangements of all rows of sub-pixels may be identical, or may be different. When the arrangements of all rows of sub-pixels are identical, the same column of sub-pixels may have the same color, which facilitates manufacturing of the pixel array. When the arrangements of all rows of sub-pixels are different, that is, sub-pixels of different colors are arranged in the same column, the display effect in the column direction may be more uniform and distortion is reduced.

In order to further increase dimension of opening on the mask plate corresponding to the sub-pixel, make the display effect in the column direction more uniform, and reduce distortion, preferably, as shown in FIG. 2, in each column of sub-pixels except columns of green sub-pixels G, starting from the first row of sub-pixels, every two adjacent rows of sub-pixels have the same color, that is, the nth row of sub-pixel and the n+2th sub-pixel have different colors. Taking the first column of sub-pixels as an example, the sub-pixel in the first row and the first column is a red sub-pixel R, the sub-pixel in the second row and the first column is a red sub-pixel R, the sub-pixel in the third row and the first column is a blue sub-pixel B, the sub-pixel in the fourth row and the first column is a blue sub-pixel B, the sub-pixel in the fifth row and the first column is a red sub-pixel R, the sub-pixel in the sixth row and the first column is a red sub-pixel R, and so on.

When the pixel array shown in FIG. 2 is manufactured, one opening on the mask plate corresponds to two sub-pixels of the pixel array, and thus the opening on the mask plate is larger in size, which makes the manufacturing easier, and further increase the yield.

As an implementation of the invention, as shown in FIG. 2, in the first row of pixel units, the starting sub-pixel is a red sub-pixel R, and in the third row of pixel units, the starting sub-pixel is a blue sub-pixel B. Colors of other sub-pixels of the first and third rows may be determined from the starting sub-pixels in the first and third rows, which will not be repeated herein.

As another aspect of the invention, a display device is provided, and includes the above array substrate provided by the invention.

As described above, since each sub-pixel in the pixel array has a relatively large size, the opening on the mask plate for manufacturing the pixel array has a relatively large size, which will increase the yield of the pixel array and reduce its production cost, and further increase the yield of the display device and reduce its production cost. In addition, the display device including the pixel array has a higher visual resolution.

The invention does not limit the type of the display device. For example, the display device may be a liquid crystal display device, and then the pixel array may be color filter blocks formed on the color filter substrate. The mask plate for manufacturing the pixel array is a mask plate used when the color filter array is manufactured by photolithography.

When the display device is an organic light-emitting diode display device, the pixel array may be an array of color light-emitting layers of organic light-emitting diodes on the display substrate which is divided into a plurality of pixel units. The mask plate for manufacturing the pixel array is a mask plate used when the color light-emitting layers are formed by evaporation.

As another yet aspect of the invention, a driving method for driving a display device is provided, the display device includes an actual pixel array, the actual pixel array includes N rows and M columns of actual pixel units, each actual pixel unit includes two actual sub-pixels, two adjacent actual pixel units in the same row include actual sub-pixels of three colors, that is, a red actual sub-pixel, a green actual sub-pixel, and a blue actual sub-pixel, every two adjacent actual sub-pixels in the same row have different colors, and in the actual pixel array, all the actual sub-pixels have the same shape, every two adjacent green actual sub-pixels are provided with an actual sub-pixel of other color therebetween, every two adjacent blue actual sub-pixels are provided with three actual sub-pixels of other colors therebetween, and every two adjacent red actual sub-pixels are provided with three actual sub-pixels of other colors therebetween, and wherein both N and M are positive integers greater than 1, the driving method includes:

Stp1. Dividing an image to be displayed into N rows and M columns of theoretical pixel units so that each theoretical pixel unit includes a red theoretical sub-pixel, a green theoretical sub-pixel and a blue theoretical sub-pixel, and the divided theoretical pixel units correspond to the actual pixel units one-by-one;

Stp2. Obtaining theoretical brightness values of the red theoretical sub-pixel, the green theoretical sub-pixel, and the blue theoretical sub-pixel of each theoretical pixel unit;

Stp3. Calculating actual brightness values of the actual sub-pixels from the theoretical brightness values of the theoretical sub-pixels so that actual brightness value of an actual sub-pixel is a sum of a part of theoretical brightness value of a corresponding theoretical sub-pixel and a part of theoretical brightness value of an auxiliary theoretical sub-pixel, the corresponding theoretical sub-pixel and the actual sub-pixel to be calculated have the same color, and a position of the theoretical pixel unit in which the corresponding theoretical sub-pixel is located corresponds to that of the actual pixel unit in which the actual sub-pixel to be calculated is located; the auxiliary theoretical sub-pixel and the actual sub-pixel to be calculated have the same color, and a position of the theoretical pixel unit in which the auxiliary theoretical sub-pixel is located is around that of the actual pixel unit in which the actual sub-pixel to be calculated is located, and does not correspond to that of the actual pixel unit in which the actual sub-pixel to be calculated is located;

Stp4. Controlling each actual sub-pixel to obtain the actual brightness value calculated in Stp3.

It should be understood that, the actual pixel array is the above pixel array provided by the invention, and the theoretical pixel array is the pixel array with pixel units arranged in FIG. 1*a* (that is, each pixel unit includes one red sub-pixel, one green sub-pixel and one blue sub-pixel), each pixel unit of the theoretical pixel array has the same size as each pixel unit in the above pixel array provided by the invention, so that the divided theoretical pixel units correspond to the actual pixel units one-by-one.

In the driving method provided by the invention, each actual sub-pixel provides light of its color not only for the pixel unit in which the actual sub-pixel is located, but also for a pixel unit around which there is the actual sub-pixel of this color. That is, if one pixel unit does not include an actual sub-pixel of one color, the pixel unit may share one actual sub-pixel of this color in the pixel unit therearound. So the output image and the input image can obtain the consistent color with the driving method provided by the invention. Moreover, the visual resolution of the display device can be larger than the physical resolution thereof with the driving method provided by the invention.

It should be pointed out that, for actual sub-pixels of different colors at different positions, the numbers of the auxiliary theoretical sub-pixels are different.

Figure 5:
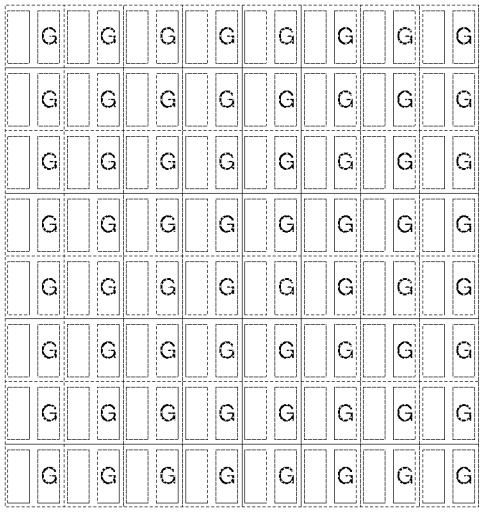
FIG. 5 is a schematic diagram illustrating a rendering method for green sub-pixels when a display device including the pixel array of the invention is driven by a driving method of the invention.

For example, for the green actual sub-pixel, the number of the auxiliary sub-pixels is 0, and then as shown in FIG. 5, the actual brightness of the green actual sub-pixel is the same as that of the corresponding theoretical sub-pixel. In this case, the first coefficient is 1, that is, there is no corresponding auxiliary sub-pixel for the green actual sub-pixel.

Figure 3:
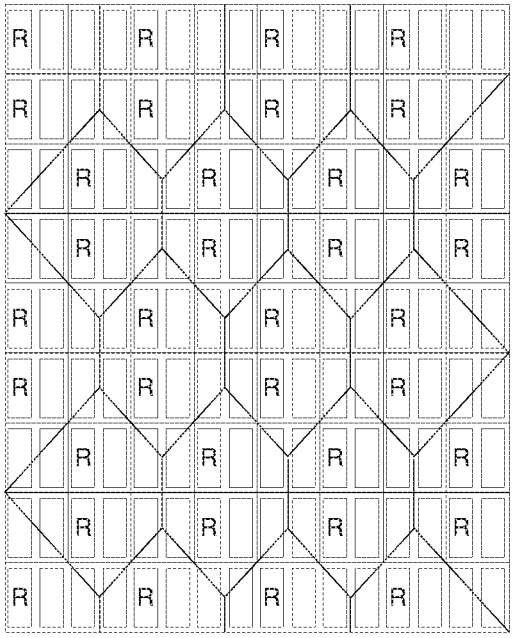
FIG. 3 is a schematic diagram illustrating positions of corresponding red theoretical sub-pixels and auxiliary red theoretical sub-pixels for red actual sub-pixels when a display device including the pixel array of the invention is driven by a driving method of the invention.

As shown in FIG. 3, each black thick wire frame is provided with only one red sub-pixel, all theoretical pixel units corresponding to the actual pixel units in the area surrounded by the black thick wire frame are used to calculate the actual brightness of the red actual sub-pixel in the area surrounded by the black thick wire frame. For example, the corresponding theoretical sub-pixel of the red actual sub-pixel in the actual pixel unit in the first row and the first column is the red theoretical sub-pixel in the theoretical pixel unit in the first row and the first column, and only one actual pixel unit provided around the red actual sub-pixel in the first row and the first column does not include a red actual sub-pixel (the actual pixel unit in the first row and the second column does not include a red actual sub-pixel), thus, the auxiliary theoretical sub-pixel of the red actual sub-pixel in the first row and the first column is the red theoretical sub-pixel in the theoretical pixel unit in the first row and the second column. Taking another example, the corresponding theoretical sub-pixel of the red actual sub-pixel in the actual pixel unit in the first row and the third column is the red theoretical sub-pixel in the theoretical pixel unit in the first row and the third column. The auxiliary theoretical sub-pixels of the red actual sub-pixel in the actual pixel unit in the first row and the third column are the red theoretical sub-pixel in the theoretical pixel unit in the first row and the second column and the red theoretical sub-pixel in the theoretical pixel unit in the first row and the fourth column.

Figure 4:
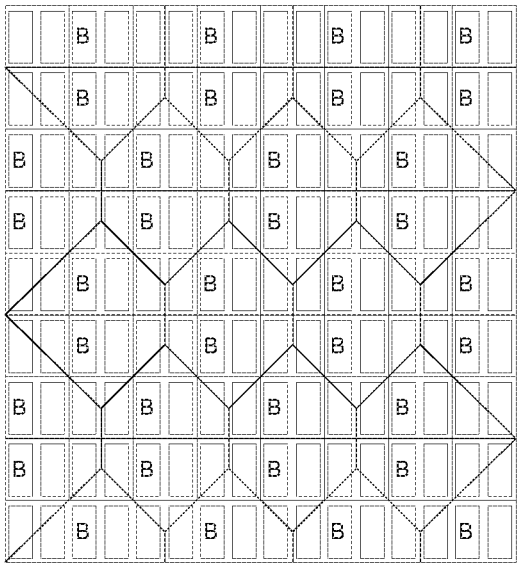
FIG. 4 is a schematic diagram illustrating positions of corresponding blue theoretical sub-pixels and auxiliary blue theoretical sub-pixels for blue actual sub-pixels when a display device including the pixel array of the invention is driven by a driving method of the invention.

As shown in FIG. 4, each black thick wire frame is provided with only one blue actual sub-pixel, all theoretical pixel units corresponding to the actual pixel units in the area surrounded by the black thick wire frame are used to calculate the actual brightness of the blue actual sub-pixel in the area surrounded by the black thick wire frame. For example, the corresponding theoretical sub-pixel of the blue actual sub-pixel in the actual pixel unit in the first row and the second column is the blue theoretical sub-pixel in the theoretical pixel unit in the first row and the second column, and two actual pixel units provided around the blue actual sub-pixel in the first row and the second column do not include blue actual sub-pixels (the actual pixel unit in the first row and the first column and the actual pixel unit in the first row and the third column do not include a blue actual sub-pixel), thus, the auxiliary theoretical sub-pixels of the blue actual sub-pixel in the first row and the second column are the blue theoretical sub-pixel in the theoretical pixel unit in the first row and the first column and the blue theoretical sub-pixel in the theoretical pixel unit in the first row and the third column.

In order to make the input image and the output image have more consistent color, preferably, in the step Stp3, the part of theoretical brightness value of the corresponding theoretical sub-pixel is a product of the theoretical brightness value of the corresponding theoretical sub-pixel and a first coefficient, the part of theoretical brightness value of the auxiliary theoretical sub-pixel is a product of the theoretical brightness value of the auxiliary theoretical sub-pixel and a second coefficient, both the first coefficient and the second coefficient are positive numbers less than 1, and a sum of the first coefficient and the second coefficient equals to 1.

As described above, as one preferable embodiment of the invention, in each column of sub-pixels except columns of green sub-pixels, starting from the first row of sub-pixels, every two adjacent rows of sub-pixels have sub-pixels of the same colors, and the nth row of sub-pixel and the n+2th sub-pixel have different colors.

As another aspect of the invention, a driving device is provided, and is applied to the above driving method provided by the invention, the driving device includes:

a theoretical pixel unit dividing module (for performing the step Stp1), configured for dividing an image to be displayed into N rows and M columns of theoretical pixel units so that each theoretical pixel unit includes a red theoretical sub-pixel, a green theoretical sub-pixel and a blue theoretical sub-pixel, and the divided theoretical pixel units correspond to the actual pixel units one-by-one;

a theoretical brightness obtaining module (for performing the step Stp2), configured for obtaining theoretical brightness values of the red theoretical sub-pixel, the green theoretical sub-pixel, and the blue theoretical sub-pixel of each theoretical pixel unit;

an actual brightness calculating module (for performing the step Stp3), configured for calculating actual brightness values of the actual sub-pixels from the theoretical brightness values of the theoretical sub-pixels so that actual brightness value of an actual sub-pixel is a sum of a part of theoretical brightness value of a corresponding theoretical sub-pixel and a part of theoretical brightness value of an auxiliary theoretical sub-pixel, the corresponding theoretical sub-pixel and the actual sub-pixel to be calculated have the same color, and a position of the theoretical pixel unit in which the corresponding theoretical sub-pixel is located corresponds to that of the actual pixel unit in which the actual sub-pixel to be calculated is located; the auxiliary theoretical sub-pixel and the actual sub-pixel to be calculated have the same color, and a position of the theoretical pixel unit in which the auxiliary theoretical sub-pixel is located is around that of the actual pixel unit in which the actual sub-pixel to be calculated is located, and does not correspond to that of the actual pixel unit in which the actual sub-pixel to be calculated is located;

an illumination controlling module (for performing the step Stp4), configured for controlling each actual sub-pixel to obtain the respective actual brightness value.

The visual resolution of the display device can be larger than the physical resolution thereof when the display device is driven by the driving method performed by the above driving device provided by the invention.

It should be understood that, the above embodiments are only exemplary embodiments used to illustrate the principle of the invention, and the invention is not limited thereto. For a person skilled in the art, various modifications and improvements may be made without departing from the spirit and substance of the invention, and these modifications and improvements should also be considered to be within the protection scope of the invention.

The invention claimed is:

1. A driving method of a display device, including an actual pixel array, wherein the actual pixel array includes N rows and M columns of actual pixel units, each actual pixel unit includes two actual sub-pixels, two adjacent actual pixel units in the same row include actual sub-pixels of three colors including a red actual sub-pixel, a green actual sub-pixel and a blue actual sub-pixel, every two adjacent actual sub-pixels in the same row have different colors, and wherein in the actual pixel array, all the actual sub-pixels have the same shape and size, every two adjacent green actual sub-pixels in the same row are provided with an actual sub-pixel of other color therebetween, every two adjacent blue actual sub-pixels in the same row are provided with three actual sub-pixels of other colors therebetween, and every two adjacent red actual sub-pixels in the same row are provided with three actual sub-pixels of other colors therebetween, and wherein both N and M are positive integers greater than 1, the driving method includes:

Stp1. dividing an image to be displayed into N rows and M columns of theoretical pixel units so that each theoretical pixel unit includes a red theoretical sub-pixel, a green theoretical sub-pixel and a blue theoretical sub-pixel, and the divided theoretical pixel units correspond to the actual pixel units one-by-one;

Stp2. obtaining theoretical brightness values of the red theoretical sub-pixel, the green theoretical sub-pixel, and the blue theoretical sub-pixel of each theoretical pixel unit;

Stp3. calculating actual brightness values of the actual sub-pixels from the theoretical brightness values of theoretical sub-pixels so that an actual brightness value of an actual sub-pixel is a sum of a part of theoretical brightness value of a corresponding theoretical sub-pixel and a part of theoretical brightness value of an auxiliary theoretical sub-pixel, the corresponding theoretical sub-pixel and the actual sub-pixel to be calculated have the same color, and a position of the theoretical pixel unit in which the corresponding theoretical sub-pixel is located corresponds to that of the actual pixel unit in which the actual sub-pixel to be calculated is located; the auxiliary theoretical sub-pixel and the actual sub-pixel to be calculated have the same color, and a position of the theoretical pixel unit in which the auxiliary theoretical sub-pixel is located is around that of the actual pixel unit in which the actual sub-pixel to be calculated is located, and does not correspond to that of the actual pixel unit in which the actual sub-pixel to be calculated is located; and Stp4. controlling each actual sub-pixel to obtain the actual brightness value calculated in Stp3, wherein in each column of actual sub-pixels except columns of green actual sub-pixels, starting from the first row of actual sub-pixels, every two adjacent rows of actual sub-pixels have the same color, two adjacent actual sub-pixels of the pixel array of the same color in the column correspond to one opening on a mask plate, and the nth row of actual sub-pixels and the (n+2)th actual sub-pixels have different colors;

in the step Stp3, the part of theoretical brightness value of the corresponding theoretical sub-pixel is a product of the theoretical brightness value of the corresponding theoretical sub-pixel and a first coefficient, the part of theoretical brightness value of the auxiliary theoretical sub-pixel is a product of the theoretical brightness value of the auxiliary theoretical sub-pixel and a second coefficient, both the first coefficient and the second coefficient are positive numbers not more than 1, and a sum of the first coefficient and the second coefficient equals to 1; and wherein for the green actual sub-pixel, the number of the auxiliary theoretical sub-pixels is 0, the first coefficient equals to 1, the second coefficient equals to 0, and there is no corresponding auxiliary sub-pixel for the green actual sub-pixel.

2. The driving method of claim 1, wherein in the first row of actual pixel units, a starting actual sub-pixel is an actual red sub-pixel, and in the third row of actual pixel units, a starting actual sub-pixel is an actual blue sub-pixel.

3. The driving method of claim 1, wherein a distance between every two adjacent blue actual sub-pixels is not more than 1270 μm.

4. A driving device of a display device, including an actual pixel array, wherein the actual pixel array includes N rows and M columns of actual pixel units, each actual pixel unit includes two actual sub-pixels, two adjacent actual pixel units in the same row include actual sub-pixels of three colors including a red actual sub-pixel, a green actual sub-pixel and a blue actual sub-pixel, every two adjacent actual sub-pixels in the same row have different colors, and wherein in the actual pixel array, all the actual sub-pixels have the same shape and size, every two adjacent green actual sub-pixels in the same row are provided with an actual sub-pixel of other color therebetween, every two adjacent blue actual sub-pixels in the same row are provided with three actual sub-pixels of other colors therebetween, and every two adjacent red actual sub-pixels in the same row are provided with three actual sub-pixels of other colors therebetween, and wherein both N and M are positive integers greater than 1, comprising a processor and a memory having instructions stored therein which, when executed by the processor, cause the processor to perform a method comprising:

dividing an image to be displayed into N rows and M columns of theoretical pixel units so that each theoretical pixel unit includes a red theoretical sub-pixel, a green theoretical sub-pixel and a blue theoretical sub-pixel, and the divided theoretical pixel units correspond to actual pixel units one-by-one;

obtaining theoretical brightness values of the red theoretical sub-pixel, the green theoretical sub-pixel, and the blue theoretical sub-pixel of each theoretical pixel unit;

calculating actual brightness values of the actual sub-pixels from the theoretical brightness values of theoretical sub-pixels so that an actual brightness value of an actual sub-pixel is a sum of a part of theoretical brightness value of a corresponding theoretical sub-pixel and a part of theoretical brightness value of an auxiliary theoretical sub-pixel, the corresponding theoretical sub-pixel and the actual sub-pixel to be calculated have the same color, and a position of the theoretical pixel unit in which the corresponding theoretical sub-pixel is located corresponds to that of the actual pixel unit in which the actual sub-pixel to be calculated is located; the auxiliary theoretical sub-pixel and the actual sub-pixel to be calculated have the same color, and a position of the theoretical pixel unit in which the auxiliary theoretical sub-pixel is located is around that of the actual pixel unit in which the actual sub-pixel to be calculated is located, and does not correspond to that of the actual pixel unit in which the actual sub-pixel to be calculated is located; and controlling each actual sub-pixel to obtain the respective actual brightness value;

wherein in each column of actual sub-pixels except columns of green actual sub-pixels, starting from the first row of actual sub-pixels, every two adjacent rows of actual sub-pixels have the same color, two adjacent actual sub-pixels of the pixel array of the same color in the column correspond to one opening on a mask plate, and the nth row of actual sub-pixels and the (n+2)th actual sub-pixels have different colors;

wherein the part of theoretical brightness value of the corresponding theoretical sub-pixel is a product of the theoretical brightness value of the corresponding theoretical sub-pixel and a first coefficient, the part of theoretical brightness value of the auxiliary theoretical sub-pixel is a product of the theoretical brightness value of the auxiliary theoretical sub-pixel and a second coefficient, both the first coefficient and the second coefficient are positive numbers not more than 1, and a sum of the first coefficient and the second coefficient equals to 1;

wherein for a green actual sub-pixel, the number of the auxiliary theoretical sub-pixels is 0, the first coefficient equals to 1, the second coefficient equals to 0, and there is no corresponding auxiliary sub-pixel for the green actual sub-pixel.

5. The driving device of claim 4, wherein in the first row of actual pixel units, a starting actual sub-pixel is an actual red sub-pixel, and in the third row of actual pixel units, a starting actual sub-pixel is an actual blue sub-pixel.

6. The driving device of claim 4, wherein a distance between every two adjacent blue actual sub-pixels is not more than 1270 μm.

* * * * *